US005217276A

United States Patent [19]

LaPointe et al.

[11] Patent Number: 5,217,276

[45] Date of Patent: Jun. 8, 1993

[54] CHAIR MECHANISM

[75] Inventors: Larry P. LaPointe, Temperance; Gerald E. Roberts, Monroe; Karl J. Komorowski, Petersburg, all of Mich.

[73] Assignee: La-Z-Boy Chair Company, Monroe, Mich.

[21] Appl. No.: 715,852

[22] Filed: Jun. 20, 1991

Related U.S. Application Data

[63] Continuation-in-part of Ser. No. 600,181, Oct. 18, 1990, Pat. No. 5,147,108.

[51] Int. Cl.[5] ..... A47C 1/02

[52] U.S. Cl. ..... 297/85; 297/68

[58] Field of Search ..... 297/83-85, 297/68, 89, 69, 70, 304, 434, 436

[56] References Cited

U.S. PATENT DOCUMENTS

| | | | |
|---|---|---|---|
| 745,706 | 12/1903 | Wilsdorf | 297/434 X |
| 1,048,306 | 12/1912 | Greilick . | |
| 2,677,412 | 5/1954 | Thomas . | |
| 2,918,110 | 12/1959 | Schliephacke . | |
| 2,918,111 | 12/1959 | Schliephacke . | |
| 2,919,745 | 1/1960 | Schliephacke . | |
| 3,033,611 | 5/1962 | Schliephacke | 297/88 |
| 3,099,487 | 12/1963 | Knabusch et al. | 297/429 |
| 3,567,280 | 3/1971 | Bradshaw | 297/318 |
| 3,858,932 | 1/1975 | Crum et al. | 297/85 |
| 3,869,169 | 3/1975 | Johnson et al. | 297/84 |
| 3,869,170 | 3/1975 | James et al. | 297/270 |
| 3,869,172 | 3/1975 | James et al. | 297/316 |
| 3,874,724 | 4/1975 | Re | 297/88 |
| 4,071,275 | 1/1978 | Rogers, Jr. | 297/85 |
| 4,072,342 | 2/1978 | Johnson et al. | 297/84 |
| 4,179,157 | 12/1979 | Shoemaker et al. | 297/83 |
| 4,226,469 | 10/1980 | Rogers, Jr. et al. | 297/85 |
| 4,291,913 | 9/1981 | Kowalski | 297/89 |
| 4,346,933 | 8/1982 | Jacobs | 297/89 |
| 4,350,387 | 9/1982 | Rogers, Jr. | 297/85 |
| 4,367,895 | 1/1983 | Pacitti et al. | 297/85 |
| 4,423,903 | 1/1984 | Gerth | 297/89 |
| 4,494,793 | 1/1985 | Rogers, Jr. | 297/85 |
| 4,668,009 | 5/1987 | Talley et al. | 297/85 |
| 4,690,454 | 9/1987 | Mizelle | 297/89 |
| 4,740,031 | 4/1988 | Rogers, Jr. | 297/85 |
| 5,011,220 | 4/1991 | LaPointe | 297/89 |

*Primary Examiner*—Kenneth J. Dorner
*Assistant Examiner*—Milton Nelson, Jr.
*Attorney, Agent, or Firm*—Harness, Dickey & Pierce

[57] ABSTRACT

A "two-way" recliner mechanism for use in articles of furniture is disclosed. The two-way recliner mechanism provides operative first and second linkages for tilting the seat assembly relative to a stationary chair frame and for extending and retracting a leg rest assembly, respectively. The first linkage mechanism is a toggle-lock mechanism operable for holding the seat assembly in the upright position and the second linkage is an over-center toggle mechanism operable for actuating the leg rest assembly. The first and second linkages are activated by a short-stroke actuator handle concealed in the upholstery of the chair, sofa or loveseat which may be easily operated by the seat occupant.

21 Claims, 6 Drawing Sheets

14
16B
16A
107
106

14
16A
107
16B
18

16B
16A
107
18
106
18

20
17
16A
107
16B
106
18
18

20
17
16B
16A
107
106

17
16A
107
18
16B
106
18

CHAIR MECHANISM

CROSS-REFERENCE TO RELATED APPLICATIONS

This is a continuation-in-part of U.S. patent application Ser. No. 07/600,181, filed Oct. 18, 1990 and now U.S. Pat. No. 5,147,108 entitled "Reclining Sofa".

BACKGROUND OF THE INVENTION

The present invention relates generally to furniture and, more particularly, to chairs and similar articles of furniture such as sofas and love seats having an improved two-way recliner mechanism incorporated therein.

Conventionally, two-way recliner type seating units (i.e. chairs, sofas, love seats and the like), have not generally been used with loose seat cushions due to height requirement associated with the mechanical recliner mechanism confined under the seat. In addition, traditional recliner mechanisms typically generate a relatively large amount of frictional drag which must be overcome for smooth movement between an "upright" and a "tilted" or reclined position. More particular, lighter weight seat occupants must normally exert a deliberate leveraged thrust or force, in addition to pulling the actuator lever, for completely extending the leg rest and moving the seat assembly to its "tilted" position. Moreover, it is often difficult for the seat occupant to return the seat assembly to the "upright" position from the "tilted" position due to the height and upward angular tilt of the seat assembly relative to the stationary chair frame.

While a plethora of two-way recliner (i.e. incliner-type) mechanisms currently exist, there remains a need for continued development of such mechanisms that are relatively simple in design and construction and therefore inexpensive to manufacture, are durable and yet are light in weight, and are quiet and easy to operate.

SUMMARY OF THE INVENTION

Accordingly, it is a basic purpose of the present invention to provide an improved support and operating mechanism for chairs, sofas, love seats and the like, of the type having a unitary seat assembly made of a seat back and seat frame and which is moveable between the normal "upright" position and the "tilted" or inclined position, such chairs being known in the furniture industry as "incliners" or "two-way recliners".

It is an additional object of the present invention to provide a compact incliner mechanism having operative linkages for "tilting" the seat assembly and for extending and retracting the leg rest assembly.

It is another object of the present invention to reduce the input force exerted by the seat occupant for smoother operation of the incliner mechanism. As a related object, the improved incliner mechanism has incorporated various linkages and drive components designed for substantially reducing frictional losses in an effort to promote easier actuation. These linkages are adapted to support any loading normally applied to the seat assembly and transfer such loading to the stationary outer frame. Furthermore, retracting movement of the leg rest assembly is utilized to assist in completely returning the seat assembly to its "upright" position. In addition, the incliner mechanism includes adjustable biasing means adapted to permit the consumer to variably adjust the resistance to such retracting movement of the leg rest assembly.

It is also a purpose of the present invention to provide an inclining seat unit wherein the weight of the person occupying the seat assembly is utilized as means to assist in moving the seat assembly from the "upright" position to the "tilted" inclined position while concurrently acting to assist in moving the leg rest assembly from its stowed position to an elevated and operative position.

Another purpose of the present invention is to provide a short-stroke actuator lever concealed in the upholstery of the chair which may be easily operated by seat occupant to concurrently operate the leg rest assembly and generate "tilting" movement of the seat assembly.

An additional purpose of the present invention is to provide an incliner mechanism which permits the use of loose and/or reversible seat cushions.

In a preferred embodiment of the present invention, the chair, sofa or love seat has a stationary outer frame with transversely aligned tracks supported on opposite sides thereof. The tracks are angled such that their front ends are lower than their back ends. An inner frame or carriage defining an integral seat assembly (i.e. rigid seat back and seat frame) is movably supported on the stationary outer frame by a pair of transversely aligned wheels, which ride in the tracks. A pair of front pivot linkages are pivotably connected between the front of the seat assembly and the outer frame for elevating the front of the seat assembly when the wheels move down the tracks.

The seat assembly is also supported on the stationary outer frame by left and right hand drive linkage assemblies. Each drive link assembly includes a long base link that is pivoted at its first end to the stationary outer frame. In addition, the drive linkage assemblies each include a short drive link that is pivotably connected to a second end of the long base link. The drive links are mounted on and directly driven by a transverse drive rod assembly which is rotatably supported on opposite sides of the seat assembly. When the pivotable connections between the drive links and the base links are below the line of centers between the drive rod and the pivot point of the first end of the base links with the outer frame, the drive linkage assemblies act as a toggle-type releasable locking means for holding and supporting the seat assembly in its upright position. Likewise, when the pivotable connections of the drive links and long base links is over center, the weight of the seat assembly and the seat occupant will cause the seat assembly to move as a unitary carriage down the tracks. Additionally, the drive linkage assemblies are also adapted to support the loading on the seat assembly, as transmitted thereto by the transverse drive rod, and transfer such loading into the stationary outer frame. As such, the drive linkage assemblies act with the rear wheels and the front pivot linkages to solidly support the seat assembly in the "tilted" or inclined and "upright" positions on the stationary outer frame.

Release means are provided for selectively moving the drive linkage assembly pivot connections "over-center" to release the seat assembly from the "upright" position for movement toward the "tilted" position. The release means include a short-stroke actuator lever or handle mounted on a side of the seat assembly. The handle is directly coupled via a two-bar transfer linkage to the drive rod. As such, limited rotation of the handle acts to proportionally rotate the drive rod for fringing the drive linkage pivot connections "over-center" to release the seat assembly for movement from the upright position.

Continued rotation of the drive rod caused by the weight of the seat assembly and the seat occupant assists in operatively extending the leg rest assembly and actuating its over-center spring toggle mechanisms. More specifically, left and right over-center spring toggle mechanisms are directly connected to the power swing links which, in turn, drive the left and right pantographic leg rest linkages for providing improved support while inhibiting side-to-side sag of the elevated leg rest assembly. The adjustable biasing means interacts with the spring toggle mechanisms for permitting variable adjustment of the desired resistance to retraction of the leg rest assembly. This allows the seat occupant to select the level of downwardly directed leg pressure that must be exerted for retracting the leg rest assembly.

Various other objects, features and advantages of the present invention will become apparent to one skilled in the art from reading the following written specification taken in conjunction with the following drawings and appended claims.

DETAILED DESCRIPTION OF THE INVENTION

In accordance with the teachings of the present invention, an improved two-way reclining mechanism for use in single person (i.e. chairs) and multi-person (i.e. sofas and loveseats) articles of furniture is disclosed. The two-way recliner mechanism of the present invention can be "tilted" (i.e. inclined) from an "upright" position and have its leg rest assembly operably retracted or extended. When a person sits in a chair, loveseat or sofa equipped with the improved two-way recliner mechanism, the leg rest assembly is extended by selectively rotating an actuator lever which is concealed in the sofa between an outer edge of the seat cushion and the inside arm. In addition, substantially concurrent "tilting" movement of the seat unit is provided upon such rotation of the actuator lever. Accordingly, the two-way recliner mechanism of the present invention is relatively compact in size to permit use of loose upholstered cushions which are modernly essential for marketing all styles of sofa or loveseat furniture.

Figures 1A, 1B, 1C, 2A, 2B, 2C:
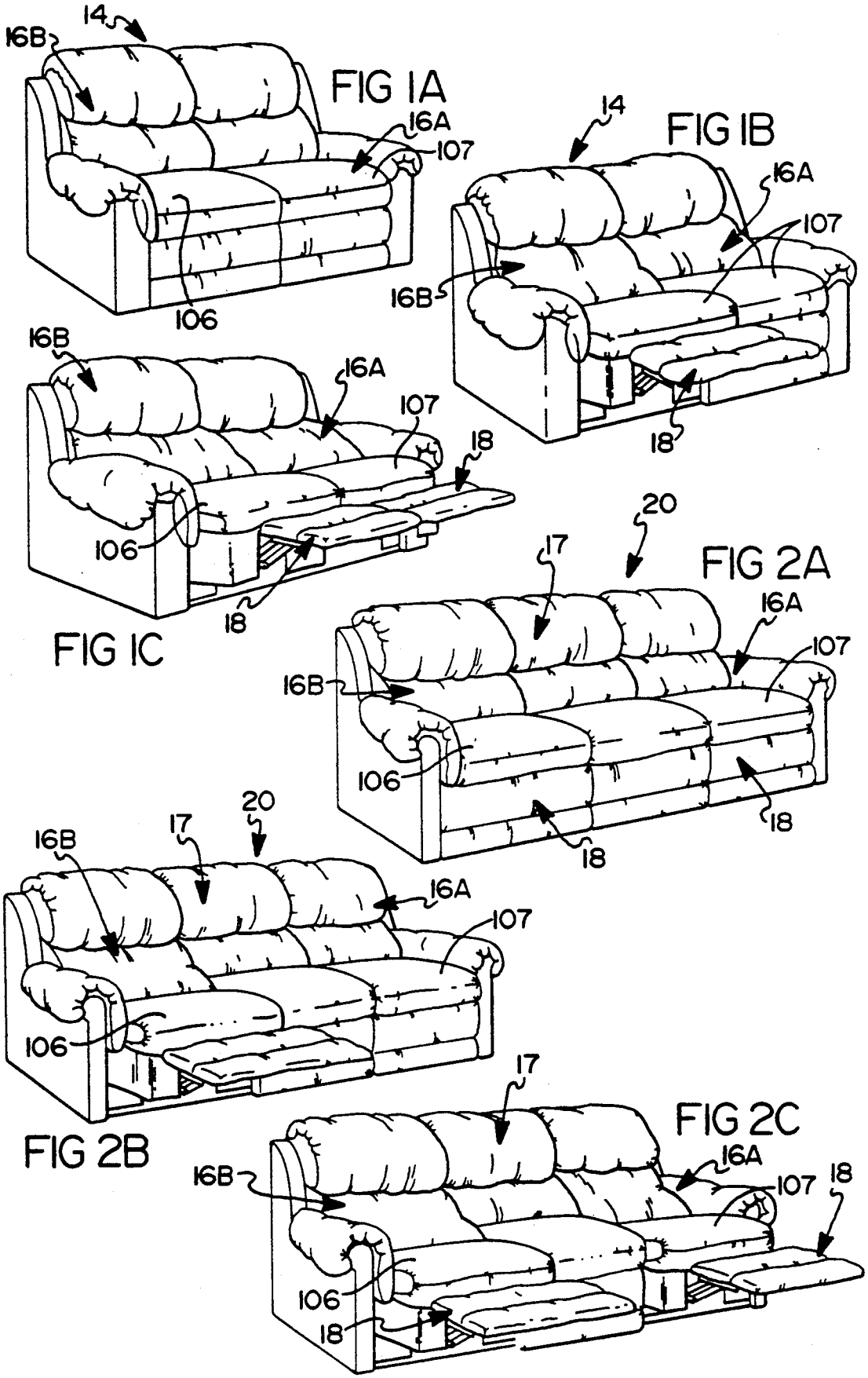
FIGS. 1A through 1C are perspective views of an exemplary upholstered "love seat" having right and left two-way reclining seat units embodying the features of the present invention and which are shown in various upright and tilted positions.
FIGS. 2A through 2C are perspective views of an exemplary upholstered "sofa" having left and right two-way reclining seat units embodying the features of the present invention and which are shown in various upright and tilted positions.

With particular references to the drawings, the operative relationship of an improved two-way recliner or "incliner" mechanism 10 of the type adapted to be supported within a stationary frame assembly 12 will now be described in greater detail. More particularly, FIG. 1A shown an exemplary loveseat 14 having left and right upholstered seat units 16*a* and 16*b*, respectively, both of which are in their "upright" position. FIG. 1B illustrates right seat unit 16*b* "tilted" or inclined with its associated leg rest assembly 18 being protracted to an elevated position. FIG. 1C depicts inclined operation of both seat units 16*a* and 16*b* and their respective leg rest assemblies 18. Similarly, an exemplary sofa 20 is shown in FIGS. 2A and 2C having left and right upholstered and reclinable seat units 16*a* and 16*b*, respectively, in various combinations of "upright" and "tilted" positions.

In general, FIGS. 5 through 8 are directed to a left side recliner mechanism 10, with its upholstery, padding, springs, etc. removed, and which is adapted for use with left seat units 16*a* of loveseat 14 and sofa 20. It will be appreciated that a two-way recliner mechanism to be used for right seat units 16*b* is substantially a mirror-image of that to be described. Moreover, the two-way recliner mechanisms associated with seat units 16*a* and 16*b* each have a concealed actuator lever 22 with a handle portion 24 provided adjacent an arm portion of the sofa or loveseat that can be easily reached by a person seated in the seating unit for convenient actuation of two-way recliner mechanism 10. However, it is to be understood that other suitable manually operable release mechanism, such as a push-button cable release or an exterior mounted actuator lever, can be readily incorporated into improved two-way recliner mechanism 10 of the present invention. Likewise, it is to be understood that while the preferred embodiments reflect incorporation of improved two-way recliner mechanism 10 in sofas and loveseats, recliner mechanism 10 is likewise well-suited for use in other articles of furniture such as chairs, modular components, and the like.

Figure 3:
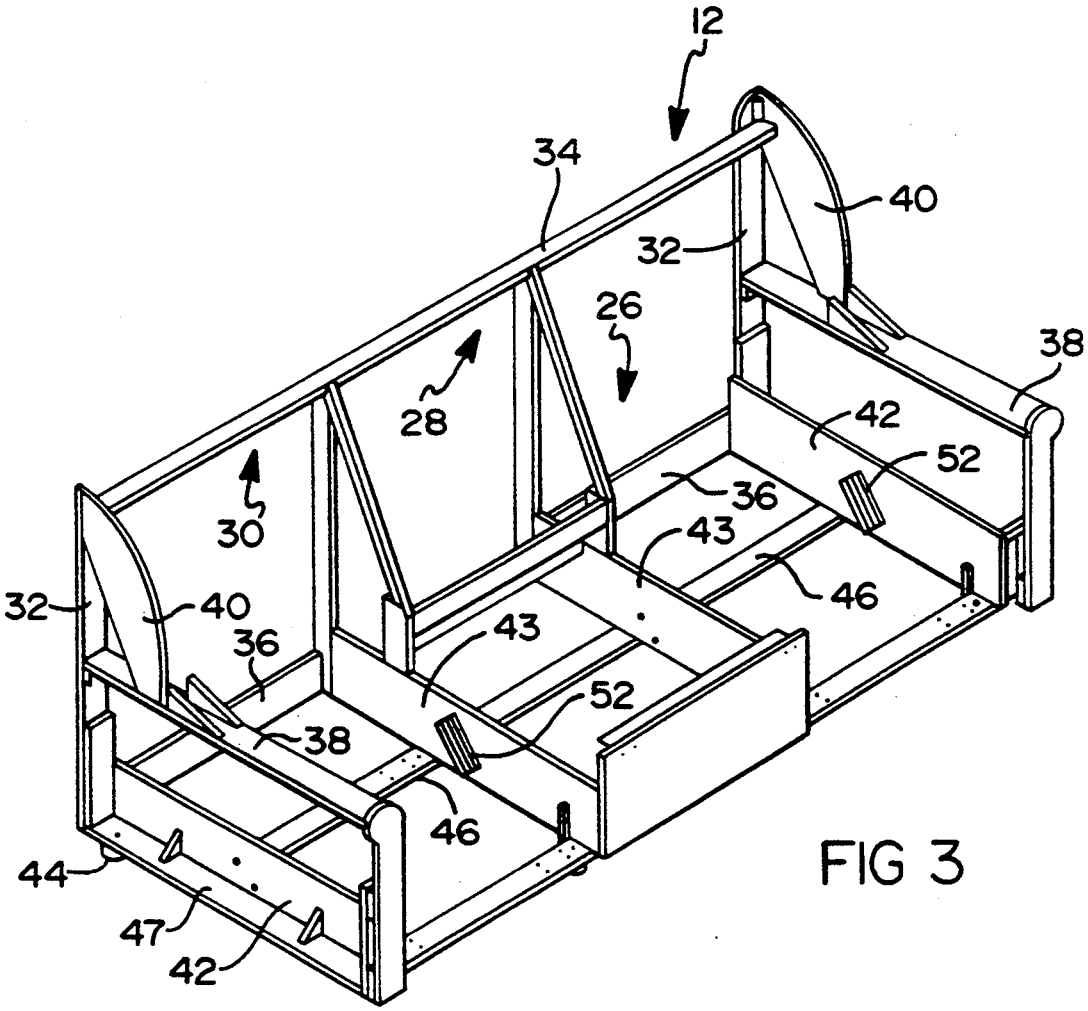
FIG. 3 is a perspective view of an exemplary outer frame assembly (with its upholstery removed) for the sofa unit of FIGS. 2A through 2C and which is adapted to movably support the improved two-way recliner mechanism of the present invention therein.

With particular reference to FIG. 3, a stationary frame assembly 12 for sofa 20 is shown which is configured to support and retain left and right two-way recliner mechanisms 10 therein. Frame assembly 12 defines three (3) frame sections 26, 28 and 30. Central frame section 28 is adapted to support a non-reclinable seat unit 17 (FIGS. 2*a* through 2*c*) thereon while outer frame sections 26 and 30 support moveable seat units 16*a* and 16*b*, respectively. As will be appreciated, loveseat 14 would have a stationary frame assembly that is substantially similar to frame assembly 12 except that center section 28 would be removed. Frame assembly 12 is preferably made of numerous wood rails that are fixedly secured together by suitable fasteners, such as dowels, staples, nails and screws, and which may be reinforced at critical joints by metal reinforcement plates or brackets and/or wood corner blocks in a known manner.

Frame assembly 12 has left and right vertical rear corner posts 32 and upper reinforcing rails 34 extending therebetween which are affixed to posts 32. Similarly, rear bottom rails 36 extend between and are affixed to a lower portion of posts 32. Frame sections 26 and 30 each include arm rails 38 which extend traversely to and are supported from posts 32. A diagonal brace piece 40 is used between arm rails 38 and an upper portion of vertical posts 32. Left and right outer side rails 42 and left and right inner side rails 43 define the vertically extending wall surfaces on which moveable seating units 16 are supported. Suitable legs or feet 44 may be affixed to the bottom of spaced bottom rails 46 and/or lower frame rails 47. Left and right recliner mechanisms 10 constructed according to the present invention are adapted to be secured to a top surface of bottom rails 46 for full two-way reclining operation within the confines of frame sections 26 and 30. Again, it is to be noted that the recliner mechanism mounted in right frame section 30 would be a right-hand version (i.e. mirror-image) of recliner mechanism 10 illustrated herein. While a specific frame assembly 12 is described, it is to be understood that it is merely exemplary for purposes of illustration only.

Each seating unit 16*a* and 16*b* has stationary frame sections 26 and 28, respectively and a wheeled carriage or seat assembly 50 that is movably supported within the respective frame sections 26 and 30. More specifically, each of side rails 42 and 43 has a forwardly and downwardly inclined metal channel 52 affixed to its inside face. Channels 52 are transversely aligned and serve as a track for wheels 54 that are supported on seat assembly 50 as will be described hereinafter in greater detail.

Figure 4:
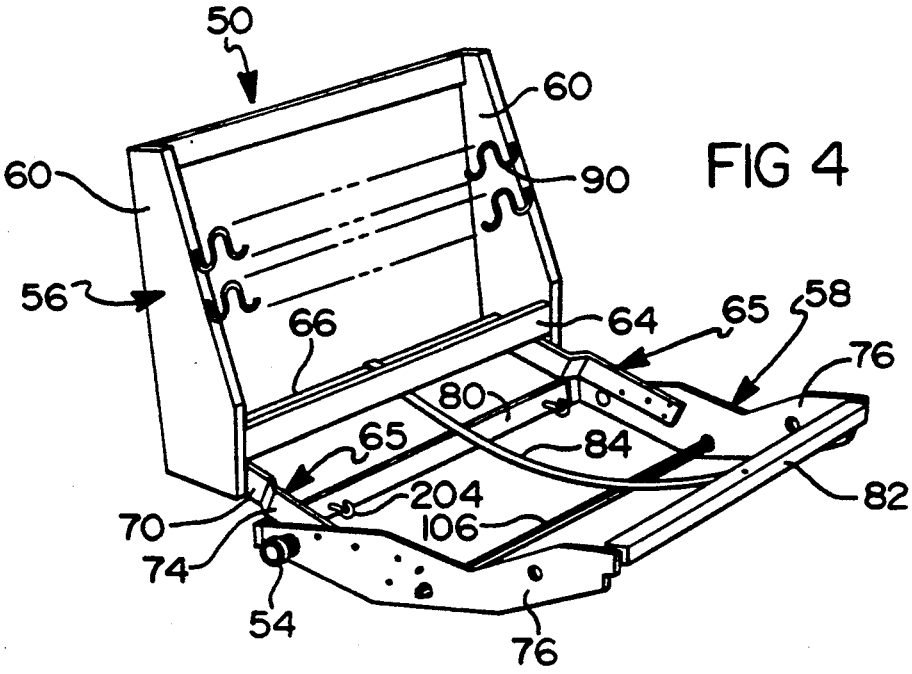
FIG. 4 is a perspective view of the unitary seat assembly or carriage unit that is operably supported for movement within the outer frame assembly shown in FIG. 3.

As best seen in FIG. 4, seat assembly 50 is a rigid unitary carriage unit preferably composed of both wood and metal parts. Thus, seat assembly 50 has a generally vertically extending seat back portion 56 and a seat frame portion 58 each of which is constructed in a manner to support springs, padding, upholstery, etc. to complete a stylish and comfortable seat structure. Seat back 56 is comprised of quadrilaterally shaped, vertically extending side rail members 60 and top and bottom front rails 62 and 64, respectively, which extend between and are affixed to side rails 60. Seat frame 58 includes a transverse rear bottom rail 66, preferably made of wood, that is affixed to right angle flange sections 68 at the rear ends of horizontally extending metal brace brackets 65. Brackets 65 have rear sections 70 fitting against the bottom inside faces of side rail members 60 and which are affixed to side rail members 60 by fasteners 72. Brace brackets 65 are outwardly offset to connect their rear sections 70 with front sections 74. Front sections 74 fit inside and against the inside face surfaces of metal seat or side plates 76 to which they are rigidly secured by suitable fasteners. The rear ends of side plates 76 have transverse inwardly extending flanges that are rigidly affixed to ends of a wooden bar 80 that serves as a rigid rear cross-rail between side plates 76. The front ends of side plates 76 have transversely inwardly extending flanges that are rigidly affixed to ends of a vertical flange portion of a metal angle bar 82 that serves as a rigid front cross-rail between side plates 76.

Figure 5:
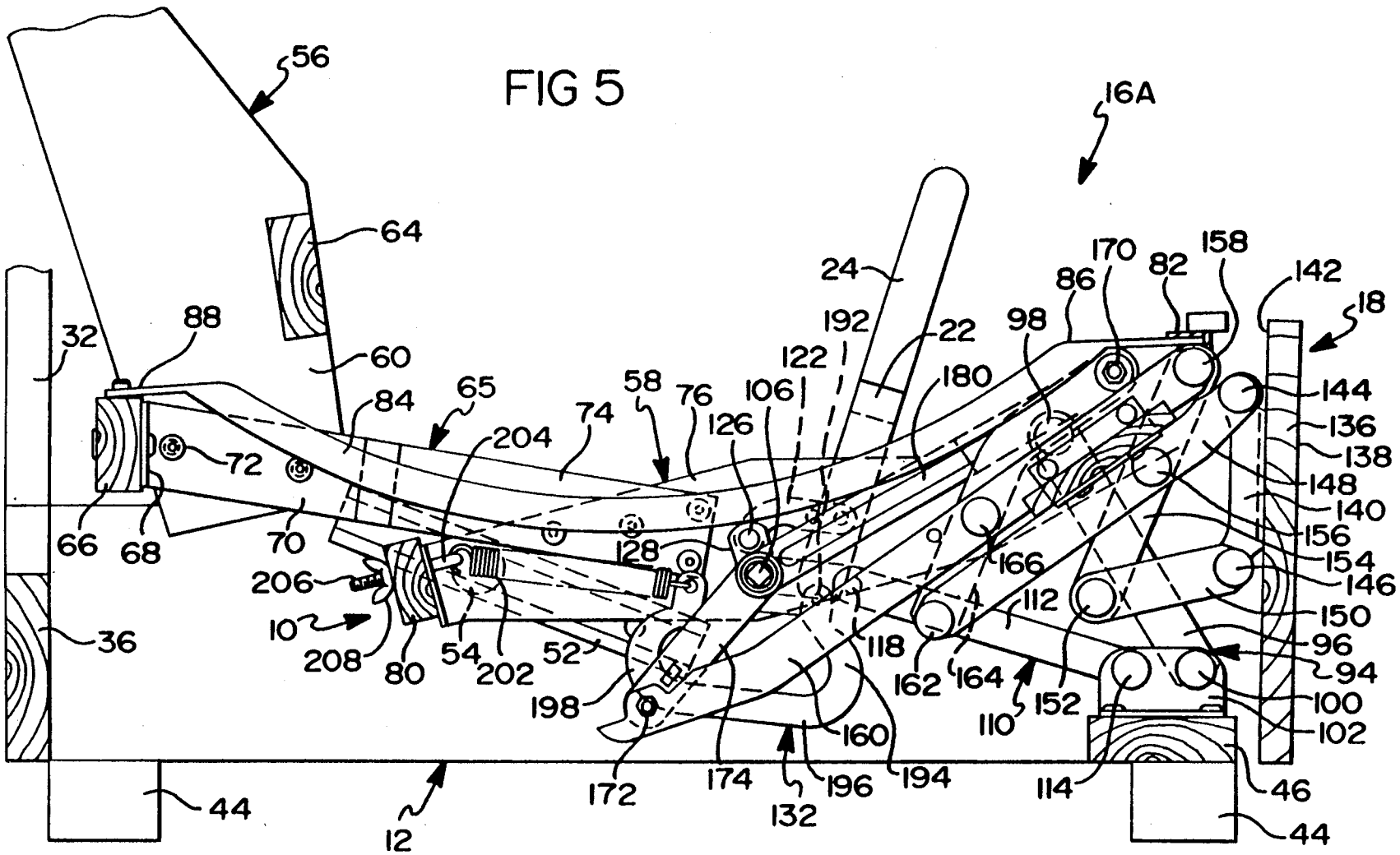
FIG. 5 is a partial sectional view through the left hand seating units shown in FIGS. 1A and 2A, with upholstery omitted and parts broken away or omitted for clarity, illustrating the seat assembly in a substantially "upright" position and the leg rest assembly in a substantially "retracted" position.
Figure 6:
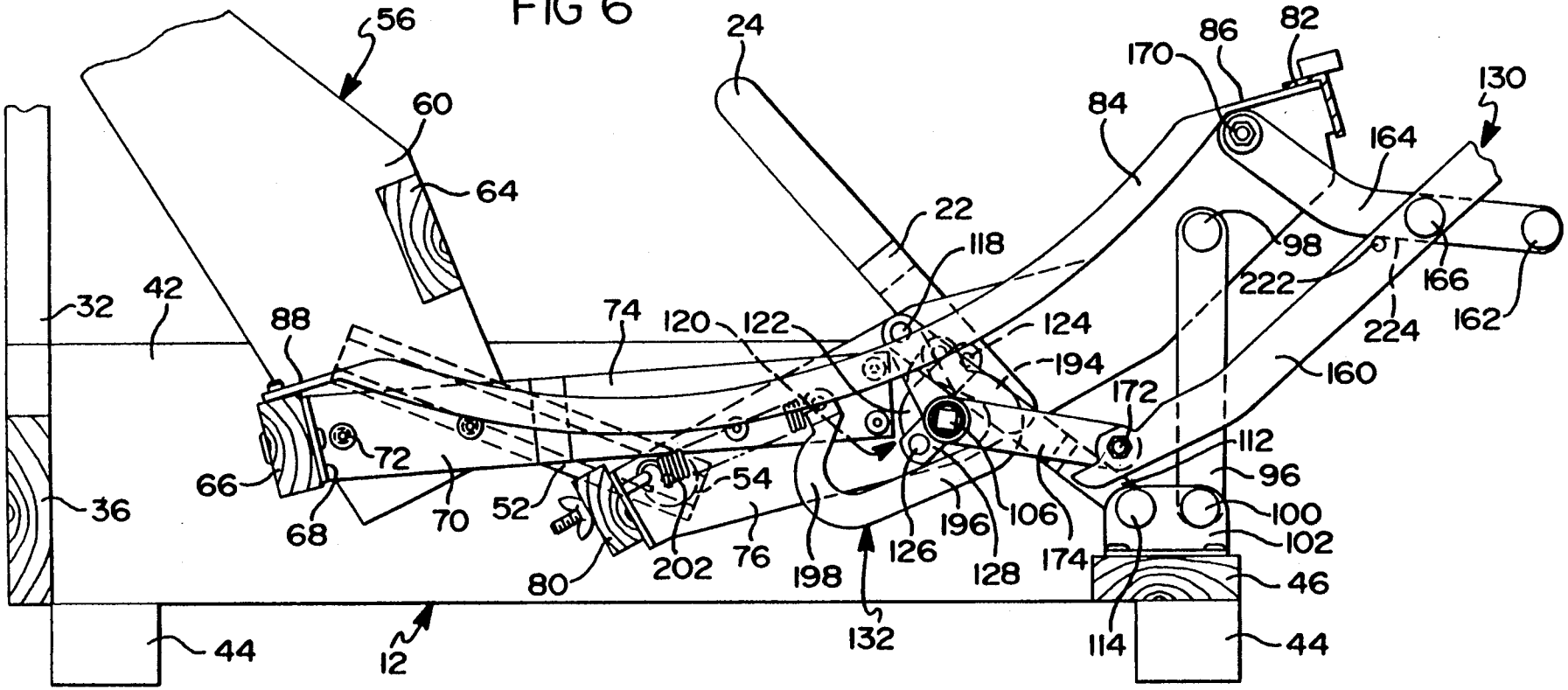
FIG. 6 is a partial sectional view, similar to FIG. 5, illustrating the leg rest assembly in an "extended" position and the seat assembly in a "tilted" position.
Figure 7:
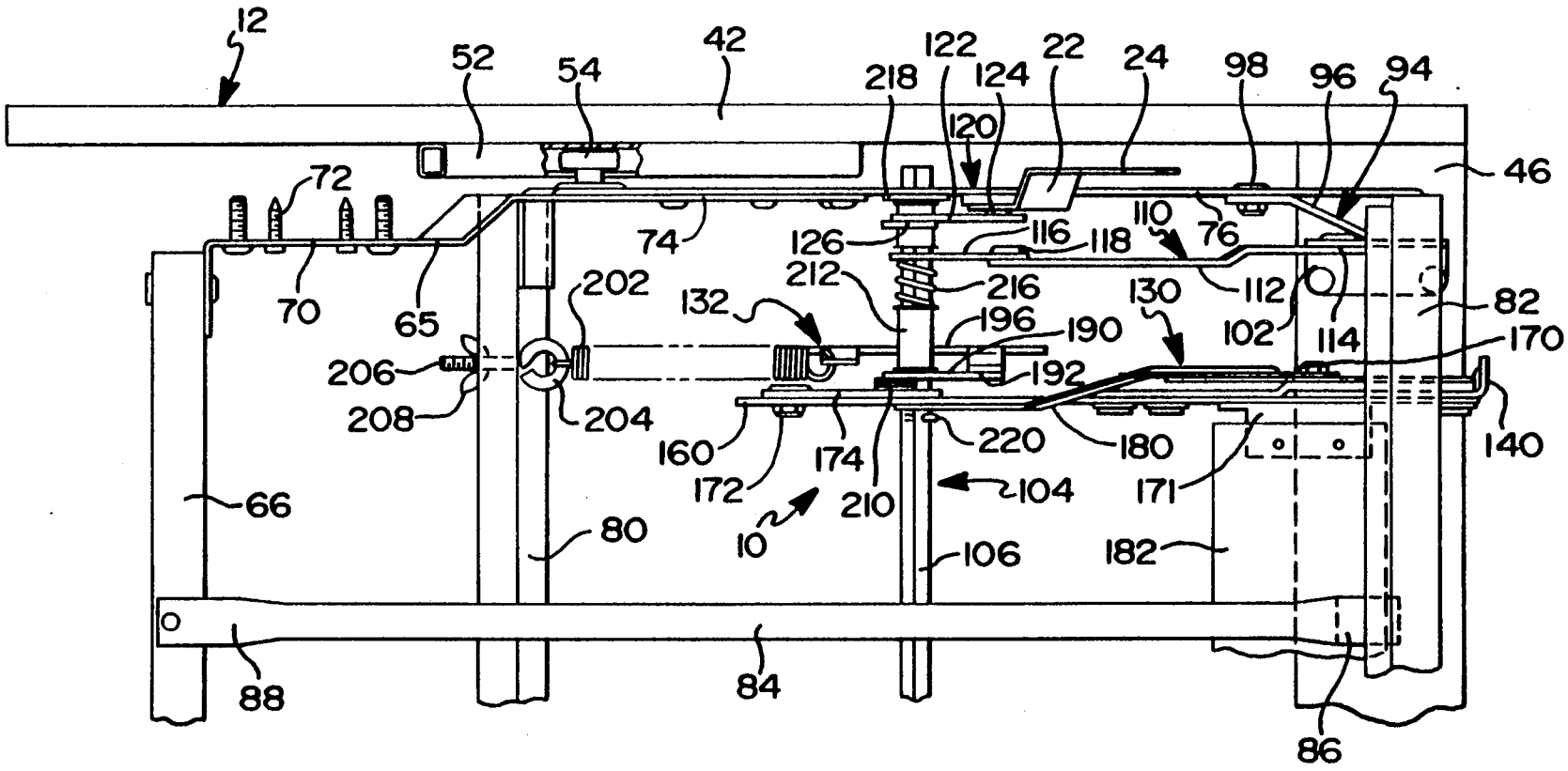
FIG. 7 is a top elevational view of the left half of the improved two-way recliner mechanism shown in FIG. 5.

As best seen in FIGS. 5 through 7, a centrally located curved tube 84 (concave upwardly) has a flattened front end 86 that is affixed to front angled cross-rail 82 and a flat end rear end 88 that is affixed to the top of wooden rear cross-rail 66, whereby tube 84 serves as a reinforcing brace for seat section 58 of carriage 50.

Resiliency is provided for seat back 58 by horizontally and transversely extending, vertically spaced, sinuous spring members 90 having opposite ends anchored on the slanted top edges of side rail members 60 as best seen in FIG. 4. Resiliency is also provided for seat 58 by horizontally and longitudinally (front to rear) extending, transversely separated, sinuous spring members (not shown) that are anchored between a horizontal flange portion of front cross-rail 82 and on a top edge of rear wood on cross-rail 80. The springs are shaped to provide the desired contour for seat back 56 and seat frame 58. In the case of seat member 58, it is preferred that the contour be basically flat so that removable cushions 107 (FIG. 1) of ordinary flat shapes can be removably supported thereon.

For purposes of clarity, the terms "tilting" or "inclining" refer to angular movement of seat unit 16 and, in turn, seat assembly 50 relative to stationary frame assembly 12. Recliner mechanism 10 is designed such that during "tilting" movement, a constant included angle between seat back 56 and seat frame 58 is maintained. Furthermore, such "tilting" movement includes translational movement of seat assembly 50 and occurs substantially concurrently with protraction of leg rest assembly 18 via sufficient rotation of actuator lever 22 by the seat occupant. Likewise, return of seat unit 16A to the "upright" position occurs concurrently with return of leg rest assembly 18 to its "retracted" position. As such, FIG. 5 illustrates the operative relationship of seat assembly 50 and leg rest assembly 18 in their respective rear substantially "upright" and "retracted" positions in which the seat occupant may enjoy conventional seating. FIG. 6 illustrates seat assembly 50 of two-way recliner mechanism 10 in a forward fully "tilted" position with leg rest assembly 18 in its "extended" elevated position. Upon sufficient rotation of actuator lever 22, seat assembly 50 is rearwardly "tilted" relative to a horizontal axis upon forward longitudinal movement on tracks 52 to the position shown in FIG. 6. Unitary carriage or seat assembly 50 is supported for longitudinal fore and aft movement within stationary frame sections 26 and 28 for generating the "tilting" movement of seat assembly 50. More particularly, when seat assembly 50 is released to move forward relative to frame assembly 12, seat assembly 50 moves to the "tilted" position. Likewise, rearward movement returns seat assembly 50 to the normal "upright" position.

Seat assembly 50 is movably supported within stationary outer frame 12 by way of side plates 76. Two rollers or wheels 54 are journally mounted by suitable fixtures to side plates 76 to rotate on a common horizontal and transverse axis located just forwardly of rear cross-rail 80. The weight of seat assembly 50 and the seat occupant is a load exerted on wheels 54 that is transmitted to tracks 52 and thus to outer frame 12. Tracks 52 are aligned in parallel facing relationship and are channel-shaped rectangular members. Therefore, since tracks 52 are downwardly and forwardly inclined, the weight of seat assembly 50 as well as the weight of the seat occupant will tend to roll wheels 54 downwardly and forwardly. Accordingly, the rear of seat assembly 50 is translated rectilinearly in a down hill direction as seat assembly 50 moves from the "upright" to the "tilted" position. While the angle of tracks 52 may be selected to obtain the desired motion, an angle of about 20 degrees to the horizontal is illustrated which guides the preferred motion of about a four inch drop and a three inch forward displacement as seat assembly 50 goes from the "upright" to the "tilted" recline position. As is apparent, two-way recliner mechanism 10 is confined below seat frame 58 with tracks 52 being affixed directly to facing wooden side rails 42 and 43 of frame assembly 12. In this manner, an overall reduction in the height of recliner 10 permits use of loose cushions 107 (FIGS. 1 and 2) removably installed on top of seat frame 58.

The front of seat assembly 50 is connected to front rails 46 of outer frame 12 by a pair of front pivot linkages 94. Pivot linkages 94 include front pivot links 96 which are pivoted at their upper first ends at pivot 98 to front portions of side plates 76, and at their lower second ends at pivots 100 to a forward vertical wall portion of angled base brackets 102. Brace brackets 102 have their horizontal walls rigidly affixed to bottom front rail 46 of outer frame 12.

In the leg rest retracted, upright seat position (FIG. 5), pivot links 96 are upwardly and rearwardly inclined (i.e. top pivot points 98 are rearward of bottom pivot points 100). Thus, upon wheels 54 being released to roll forwardly (and downwardly) in tracks 52, the forward motion of side plates 76 will also carry first pivots 98 forwardly. As such, pivot links 96 will pivot forwardly about their bottom second pivots 100 for raising the front ends of side plates 76 at the same time that the rearward ends of side plates 76 are being lowered by rectilinear movement of wheels 54 within straight and downwardly inclined tracks 52. In this way seat assembly 50 pivots about the axis of wheels 54 so that seat back 56 is tilted backwardly and the front edge of seat frame 58 is tilted upwardly when seat assembly 50 is released to move forwardly in tracks 52. The limit of tilting or incline is reached when pivot links 96 are substantially vertical as shown in FIG. 6. Since there is no relative movement between seat back 56 and seat section 58 of seat assembly 50, removable cushions 107 are therefore not disturbed by the forward motion or by tilting action.

As previously noted, actuator lever 22 is hidden in the space between the outside edge of cushion 106 and the upholstered inside face of sofa 20 and must be rearwardly pivoted (i.e. pulled back) two or three inches by its handle 24 when the seat occupant wants to release seat assembly 50 for "tilting" it and raising leg rest 18. More specifically, pulling back on actuator lever 22 produces angular movement (counterclockwise in the drawings) of a square cross section transverse drive rod assembly 104 which is rotatably supported by suitable means at its opposite ends by side plates 76 of seat assembly 50. The axis of rotation for drive rod 106 is generally parallel to the axis of rotation of wheels 54 and spaced forwardly thereof but rearwardly of the axis of pivots 98. As will be seen hereinafter, seat assembly 50, leg rest assembly 18, and drive rod assembly 104 are operatively interconnected via various linkages so that when one moves, all move (i.e. rotation of drive rod 106 is accompanied by movement of seat assembly 50 and leg rest assembly 18). Moreover, upon the seat occupant pivoting handle 24 through an angle of about 30°–45°, (which, in turn, correspondingly rotates drive rod 106) seat assembly 50 is released such that the weight of the seat occupant in cooperation with the force amplification and mechanical advantage of drive rod assembly 104 act to release causes forward movement of seat assembly 50 relative to stationary frame 12 for smoothly and continuously driving the various linkages until seat assembly 50 is in the fully forward "tilted" position with leg rest 18 extended.

Angular movement of drive rod 106 about its axis results in movement of various linkage mechanisms for causing substantially concurrent actuation of leg rest assembly 18 and "tilting" movement of seat assembly 50. As will be appreciated, the various linkages are designed to only require a limited range of angular movement of drive rod 106 via limited rotation of actuation lever 22 for putting recliner mechanism 10 into operation. In addition, the weight of the seat occupant and the center of gravity of seat assembly 50 defined, by the orientation of wheels 54 within tracks 52, combine to generate a forwardly directed force on seat assembly 50 which augments the limited occupant input required for improved operation of two-way recliner 10. In addition, over-center toggle linkages 132 for leg rest assembly 18 and toggle-lock linkages 110 for seat assembly 50, to be described hereinafter, are designed to selectively lock and drive seat assembly 50 and leg rest assembly 18 between their respective "upright" and "retracted" positions and their "tilted" and "extended" positions.

With particular reference now to FIGS. 5 through 8, first linkage means are provided for releasably locking drive assembly 104 and which is operable for retaining seat assembly 50 in its "upright" position. More particularly, the first linkage means includes left and right drive linkage assemblies 110 which are interconnected between bottom rails 46 of frame assembly 12 and drive rod 106 for acting as an over-center toggle-lock mechanism for releasably "locking" seat assembly 50 in the rear-upright position shown in FIG. 5. Drive linkage assemblies 110 includes a long base link 112 having its first lower end pivotally supported about a first pivot 114 to angled bracket 102. The second upper end of base link 112 is pivotably coupled to a drive link 116 about second pivot point 118. An opposite end of drive link 116 is directly coupled to drive rod 106 so as to inhibit free angular movement of drive link 116 relative thereto. In particular, drive link 116 includes a square aperture sized to receive square drive rod 106 therethrough in a close-fitting manner. As such, angular movement of drive rod 106 about its axis causes corresponding rotation of short drive links 116. As seen in FIG. 7, drive links 116 are in approximate longitudinal alignment with the vertical wall portion of angle bracket 102. An imaginary reference "line-of-action" between the center of drive rod 106 and the center of first pivot 114 is a key reference feature. When seat assembly 50 is in the "upright" position, second pivot 118 is slightly below the "line-of-action" reference line (i.e. below center), each base link 112 and its drive link 116 act, in effect, as a locking strut that inhibits rotation of drive rod 106 and, in turn, prevents forward movement of seat assembly 50. However, when drive rod 106 is sufficiently rotated by selective and deliberate rearward movement of actuator lever 22 in a counterclockwise direction, second pivots 118 are lifted above the reference lines (i.e. above center). Thus, base links 112 no longer resist forward movement such that the effect of gravity causes seat assembly 50 to move forwardly. Therefore, seat assembly 50 is "released" for free forward tilting and translational movement with respect to outer frame 12. In particular, as this occurs, base links 112 pivot upwardly such that pivot points 118 move upwardly and forwardly, in an arc about first pivot 114. Such motion acts to lift the front end of drive links 116 which, in turn, drivingly rotate drive rod 106 for causing substantially simultaneous and automatic operation of leg rest assembly 18. However, as will be appreciated hereinafter, left and right spring-assist toggle mechanisms 132 associated with operation of leg rest assembly 18 work coactively with toggle-lock drive linkage assemblies 110 to smoothly and continuously drive two-way recliner mechanism 10 for extending leg rest assembly 18 and for "tilting" seat assembly 50 in a substantially concurrent manner.

In accordance with a novel feature of the present invention, an improved manually-operable actuator release mechanism is disclosed. The improved release mechanism substantially simplifies the required interactive components while producing improved operational characteristics. In general, actuator lever 22 is operatively coupled to drive rod 106 such that its pivotable travel is directly proportional to the amount of rotation of drive rod 106 that is produced. Furthermore, the improved release mechanisms produces a supplemental restraining force component which assists in holding leg rest assembly 18 in its "retracted" condition. The supplemental restraining force is generated by the mechanical advantage associated with the release mechanism in conjunction with frictional engagement between handle 24 and cushion 107. More particularly, a lower end of actuator lever 22 opposite to handle 24 is pivotally supported for angular movement to one of side plates 76 with the pivot point being located slightly forward of drive rod 106. A transfer linkage 120 connects actuator lever 22 to drive rod 106 for directly transferring angular movement thereto. Accordingly, a first end of a J-shaped transfer link 122 is pivotally coupled at 124 to a central portion of actuator lever 22 and a second end of J-shaped transfer link 122 is pivotally coupled at 126 to a first end of a short drive link 128. The second end of drive link 128 has a square hole through which square drive rod 106 passes in a close-fitting manner, whereby drive link 128 and drive rod 106 rotate together. As a further feature, transfer linkage 120 provides significant mechanical force amplification so that the input force required for the seat occupant to deliberately pivot handle 24 is not excessive.

With particular reference now to FIGS. 5 and 6, leg rest linkage assembly 18 is shown to include left and right pantograph linkages 130, and left and right over-center toggle linkage mechanism 132. Pantograph linkage 130 are similar to corresponding mechanisms shown and described in the present assignee's U.S. Pat. No. 5,011,220, issued Apr. 30, 1991, entitled "Reclinable Chair". In general, leg rest assembly 18 comprises a frame board 136 having an upper surface 138 that is padded and upholstered so that in the finished chair, sofa, loveseat or the like will be as shown in FIGS. 1 and 2. Frame board 136 is supported on and moved by the left and right hand pantograph linkages 130. Since left and right pantographs 130 are the same, only one will be described. Frame board 136 has an angle shaped bracket 140 secured to its bottom face 142 whereby it is pivotally connected at a rear pivot 144 and a front pivot 146 to first and second board links 148 and 150, respectively, of pantograph 130. The other end of second board link 150 is pivoted at 152 to an end of connector link 154 which is centrally pivoted at 156 to an upper part of first board link 148. The other end of connector link 154 is pivoted at 158 to the top of long support link 160.

The other end of first board link 148 is pivoted at 162 to a lower end of a curved link 164, link 164 being pivoted at a central pivot 166 to a central part of long support link 160. An upper end of curved link 164 is pivoted at 170 to the rear end of a rearwardly extending bracket 171 that is affixed to the bottom of front cross-rail 82, and extending rearwardly therefrom. Pivot 170 is a point of support on seat member 58 for pantograph 130.

Another point of support is pivot 172 at the curved bottom end of long support link 160 which connects support link 160 to a first end of power swing link 174. A second end of power swing link 174 has a square hole through which square drive rod 106 extends in a close-fitting manner. Thus, rotation of drive rod 106 acts to rotate power swing link 174 which, in turn, acts through pivot 172 to move long support link 160. In turn, curved link 164 is caused to swing about fixed pivot 170 by virtue of central pivot 166 that it has with long support link 160. Therefore, first board link 148 moves while pivot 158 at the top end of long support link 160 causes connector link 154 to move and, thus, second board link 150. This extensible action takes place substantially synchronously for both the left hand and right hand pantographic linkage mechanisms 130 when there is sufficient angular movement of drive rod 106 to unlock over-center toggle mechanism 132. As noted, release of over-center toggle mechanism 132 occurs substantially concurrently with release of seat assembly 50 via drive linkages 110 for forward movement thereof in response to sufficient, yet limited, rotation of drive rod 106. Accordingly, frame board 136 is moved between its "retracted" or stored vertical position (FIG. 5) and its "extended" elevated, horizontal position (FIG. 6).

Spacer links 180 are pivotally supported at their bottom end on drive rod 106 and at their top end on pivot 170 to bracket 171. Spacer link 180 serve to stabilize and locate drive rod 106 and pantograph linkage mechanism 130 with respect to seat assembly 50. Board 182 shown in FIG. 7 is a mid-ottoman board which can be secured at its opposite ends to the inwardly facing portions of left and right long support links 160.

In general, left and right hand over-center toggle linkage assemblies 132 are spring-assisted devices operably associated with right and left pantograph linkages 130 of leg rest assembly 18. More specifically, toggle linkages 132 provide linkage means for holding leg rest assembly 18 tightly in the fully retracted position against the front of frame assembly 12 and also provides means for supplying a spring force for driving leg rest assembly 18 to its "extended" position. Toggle linkage assemblies 132 each include a toggle lever 190 having a square hole for mounting toggle levers 190 on square drive rod 106 in a close-fitting manner for direct rotation therewith. Toggle lever 190 is pivotally connected at 192 to front leg 194 of a C-shaped toggle link 196 that curves around, below and to the rear of drive rod 106 where its rear leg 198 has an opening 200 in which one end of a helical coil spring 202 is hooked. The opposite end of coil spring 202 is hooked to an eye screw 204 having its thread stud 206 secured to rear wood rail 80. As best seen in FIG. 7, a wing nut 208 is provided for adjusting the tension in spring 202 acting on toggle link 196. For example, the tension in spring 202 can be adjustably relieved for a lighter weight occupant or it can be increased for a heavier seat occupant. Such adjustment means provide an extra comfort and convenient feature to recliner mechanism 10.

Figure 8:
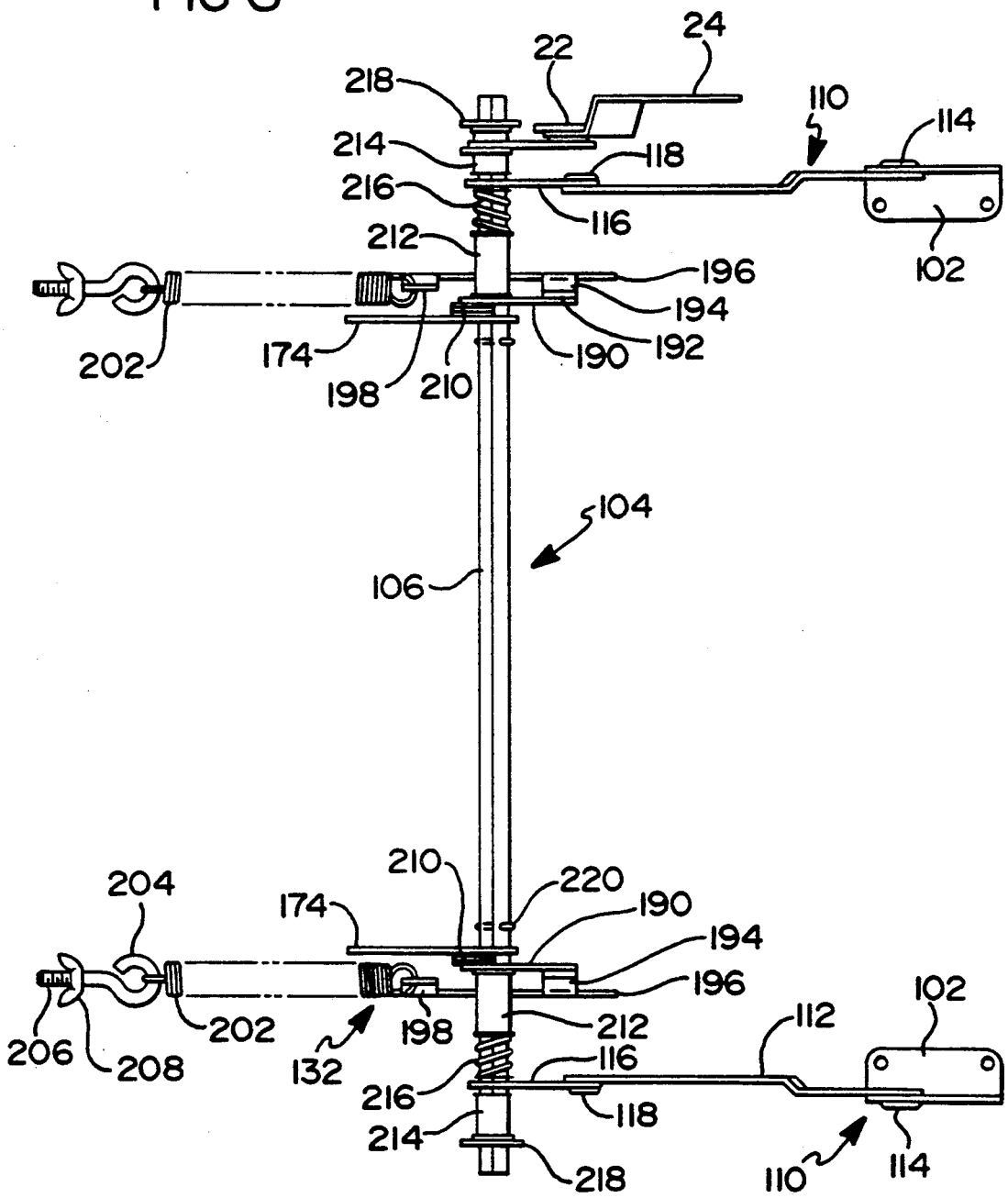
FIG. 8 is a plan view of the drive rod assembly incorporated within the improved two-way recliner mechanism of the present invention.

In accordance with a novel feature of the present invention, coupling means are provided for directly coupling pantograph linkages 130 with over-center toggle linkages 132 to provide improved rigidity while minimizing side-to-side sag of leg rest assemblies 18 in their "extended" position. More specifically, toggle lever 190 is rigidly connected to a portion of power swing link 174 in close proximity to square drive rod 106. As best seen in FIGS. 7 and 8, one or more washers 210 are interposed between adjacent side surfaces of toggle levers 190 and power swing links 174 and are rigidly secured therebetween by a suitable fasteners. This additional rigidity "takes-up" or substantially eliminates stack-up tolerance variations between left and right pantograph linkages 130 and between drive rod 106 and the square aperture formed in power swing links 174 so as to provide a rigid interconnection between drive rod 106 and each of the extensible pantograph linkages 130. Accordingly, coil springs 202 are operatively coupled directly to power swing links 174 for driving pantograph linkages 130 between their "retracted" and "extended" positions.

Another feature of the present invention includes the use of inner and outer spacer tubes 212 and 214, respectively, and coil springs 216 concentrically supported on drive rod assembly 104 for retaining the various linkages in their proper orientation thereon. More specifically, coil springs 216 acts to preload inner and outer spacer tubes 212 and 214, respectively, for aligning toggle-lock drive linkages 110 and pantograph linkages 130 within a predetermined length of drive rod 106 as defined between side spacer 218 (adjacent side plate 76) and cotter pin 220 extending through drive rod 106.

To provide means for determining the limits of the angular tilting and forward translational movement of seat assembly 50 and the fully extended position of leg rest assembly 18, stop pins or rivets 222 extend outwardly from long support link 160 which are adapted to engage a lower edge surface 224 of curved links 164. This abutting engagement acts to prevent any further rotation of drive rod 106 while concurrently providing rigidly and stability to two-way recliner mechanism 10.

Operation of over-center toggle linkage assemblies 132 will now be described in greater detail. The location of pivot 192 below drive rod 106 and the line of action of coil springs 202 are such in the retracted position of leg rest assembly 18 that the spring force holds or "retains" leg rest assembly 18 in the retracted condition. As leg rest assembly 18 is initially slightly extended upon counterclockwise rotation of actuator lever 22 and, in turn, drive rod 106, pivot 192 moves up and "over-center" of the long axis of drive rod 106. Once pivot 192 is over center, tension loading on coil springs 202 assist in drivingly rotating drive rod 106 for elevating leg rest assembly 18 as rear leg 198 of toggle link 196 is pulled toward reinforcement rail 80. In addition, coil springs 202 are operable to assist the seat occupant in pivoting handle 24 through the require actuation angle. Once drive rod 106 has been sufficiently pivoted through the relatively small actuation angle required to release seat assembly 50 for forward movement (via drive linkage assemblies 110) and leg rest assembly 18 (via toggle mechanisms 132), the weight of the seat occupant and the biasing of coil springs 202 continue to rotate handle 24 to the fully pivoted and concealed position shown in FIG. 6.

Downward pressure applied manually to frame board 136 by the seat occupant serves as means to move leg rest assembly 18 back to the "retracted" position and seat assembly 50 rearwardly for tilting the seat assembly 50 to the "upright" position. Such pressure has the benefit of a long moment arm and produces a downward rearward movement of long support links 160 which act through their pivots 172 to rotate power swing links 174 in a rearward direction. This causes corresponding angular movement of drive rod 106 (i.e. clockwise in the drawings). Concomitantly, pivot 192 is rotated "over-center" upon continued clockwise movement of drive rod 106 such that C-shaped toggle links 196 and coil springs 202 act as a locking means to solidly hold leg rest assembly 18 in its stowed position. Likewise, this same clockwise rotation of drive rod 106 causes drive links 116 and long base links 112 of toggle-lock linkage assemblies 110 to be rotated "below" drive rod 106 for retaining seat assembly 50 against forward movement which, in turn, assist in lockingly retaining seat unit 16 in its "upright" position. It will be appreciated that the various linkages are designed to work substantially simultaneously and in a cumulative manner. The relatively low input retractive force to be exerted on frame board 136 by the seat occupant permits smooth retraction of incliner mechanism 10 to the conventional seating arrangement position of FIG. 5.

Thus, the present invention provides a seat construction that permits a seat assembly 50 to move between the "upright" position (FIG. 5) and a "tilted" or inclined position (FIG. 6) located ahead of the "upright" position. Gravity is used to drive seat assembly 50 from the upright to the tilted position. Manual force, leveraged through the leg rest linkages 130, is used to overcome gravity and return seat assembly 50 from the tilted to the upright position.

While the drawings show two-way reclining mechanism 10 of the present invention embodied in a loveseat and sofa, it could also be used in single person chairs as well as modular sections, or other articles of furniture. Modifications in the specific structure shown may be made without departing from the spirit and scope of the invention.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A seating unit for use in an article of furniture of the type having a stationary frame section within which said seating unit is secured for longitudinal and angular movement therein, said seating unit comprising:

a seat assembly having a seat member and a seat back;

support means for supporting said seat assembly for translational and tilting movement relative to said stationary frame section between an upright position and a tilted position;

a leg rest assembly supported from said seat assembly for movement between a retracted position when said seat assembly is in said upright position and an extended position when said seat assembly is in said tilted position;

drive means for operatively connecting said seat assembly and said leg rest assembly, said drive means being moveable between a locked position wherein said seat assembly is retained in said upright position and a released position wherein said seat assembly is permitted to move toward said tilted position;

first linkage means operatively coupling said seat assembly to said drive means for releasably locking said seat assembly in said upright position when said drive means is in said locked position, and for permitting said seat assembly to move to said tilted position when said drive means is in said released position;

second linkage means having first and second portions for retaining said leg rest assembly in said retracted position when said drive means is in said locked position, and for driving said leg rest assembly toward said extended position when said drive means is in said released position;

coupling means for directly coupling said first portion of said second linkage means to said leg rest assembly for assisting said drive means in moving said leg rest assembly between its retracted and extended positions;

manually-operated actuation means coupled to said drive means for permitting a seat occupant to deliberately move said drive means between said locked and released positions, said manually-operated actuation means including an actuator lever pivotably secured to said seat assembly, a first drive link mounted for direct movement with said drive means, and a transfer linkage pivotably connecting said actuator lever to said first drive link; and adjustable biasing means disposed intermediate said second portion of said second linkage means and a portion of said seat assembly and coactive with said second linkage means for generating a user adjustable biasing force to assist in holding said leg rest assembly in said retracted position and in urging said leg rest assembly into said extended position.

2. The seating unit of claim 1 wherein said drive means includes a transverse drive rod supported for rotational movement with respect to said seat assembly and for translatory movement with said seat assembly with respect to said stationary frame section, and wherein said drive link of said manually-operated actuation means is directly connected to said drive rod for permitting a seat occupant to rotate said drive rod in a first direction through a predetermined actuation angle via pivotable movement of said actuator lever for causing said first linkage means to release said seat assembly for movement to said tilted position.

3. The seating unit of claim 2 wherein said support means includes track means that are downwardly angled from back to front of said seating unit and front pivot link means pivotably interconnecting a front portion of said seat member to said stationary frame section, and wherein said seat assembly includes wheel means which are disposed for rolling movement within said track means, whereby the weight of said seat assembly and said seat occupant urge said seat assembly toward said tilted position and said drive rod to continue to rotate in said first direction for moving said leg rest assembly toward said extended position upon rotation of said actuator lever through said predetermined actuation angle.

4. The seating unit of claim 2 wherein said first linkage means comprises a toggle-lock linkage mechanism interconnected between said drive rod and said stationary frame section whereby rotation of said drive rod moves said toggle-lock linkage mechanism and movement of said toggle-lock linkage mechanism rotates said drive rod.

5. The seating unit of claim 4 wherein said toggle-lock linkage mechanism comprises a two-bar linkage comprising a second drive link having a first end directly coupled for rotation to said drive rod and a base link having a first end pivotally connected about a first pivot to a second end of said second drive link, a second end of said base link pivotably connected about a second pivot to said stationary frame section, said toggle-lock linkage mechanism being operative to lock said seat assembly in said upright position and inhibit rotation of said drive rod in said first direction when said first pivot is below a line of center defined by said drive rod, and said toggle-lock linkage mechanism being operative to release said seat assembly for movement toward said tilted position and for permitting continued rotation of said drive rod in said first direction when said first pivot is above said line of center of said drive rod.

6. The seating unit of claim 5 wherein said leg rest assembly includes pantograph linkage means having a power swing link drivingly connected to said drive rod such that rotation of said drive rod moves said power swing link and said pantograph linkage means; and wherein movement of said pantograph linkage means causes movement of said power swing link for rotating said drive rod; and wherein said second linkage means and said adjustable biasing means comprise a spring-assisted toggle linkage mechanism having a toggle lever directly connected for rotation with said drive rod and a spring-assisted over-center toggle means operatively coupled between said seat assembly and said toggle lever, said over-center toggle means being adapted for retaining said leg rest assembly in said retracted position when said drive rod is in said locked position, and said over-center toggle means being adapted for forwardly driving said leg rest assembly toward said extended position upon release of said seat assembly.

7. The seating unit of claim 6 further including stop means associated with said pantograph linkage means for inhibiting additional forward movement of said seat assembly when said seat assembly is in said tilted position, and wherein said stop means inhibits further extension of said pantograph linkage means when said pantograph linkage means is in said extended position.

8. The seating unit of claim 6 wherein a rearwardly directed force applied to said leg rest assembly by said seat occupant acts to rotate said drive rod in a second opposite direction for moving said leg rest assembly toward said retracted position, whereby rotation of said drive rod in said second direction causes said seat assembly to move toward its upright position until said toggle-lock linkage mechanism inhibits further rotation of said drive rod for retaining said seat assembly in said upright position.

9. The seating unit of claim 6 wherein said coupling means is adapted to directly interconnect said toggle lever to said power swing link.

10. The seating unit of claim 9 wherein said coupling means comprises at least one washer member interposed between adjacent sides of said toggle lever and said power swing link, said washer member being secured therebetween so as to facilitate movement of said power swing link during rotation of said drive rod.

11. The seating unit of claim 9 wherein said toggle lever is secured directly to said drive rod for rotation therewith, and wherein said spring assisted over-center toggle means comprises a C-shaped toggle link having a first leg and a second rear leg, said first leg of said C-shaped toggle link curving around and below said drive rod to said second rear leg, and spring means secured between a portion of said seat assembly rearward of said toggle link and said second rear leg thereof, whereby said spring means urges said drive rod to rotate in a second direction for concurrently biasing said leg rest assembly toward its retracted position when said pivot connection between said toggle lever and said front leg of said toggle link is located below said line of center of said drive rod, and wherein said spring means acts to urge said drive rod to rotate in said first direction to forwardly drive said leg rest assembly toward its extended position when said pivot connection between said toggle lever and said front leg of said toggle link is located above said line of center of said drive rod, said coupling means adapted to operably connect said leg rest assembly and said drive rod with said spring means.

12. A seating unit for use in an article of furniture of the type having a stationary frame section within which said seating unit is secured for longitudinal and angular movement therein, said seating unit comprising:

a seat assembly having a seat member and a seat back;

support means for supporting said seat assembly for translational and angular tilting movement relative to said stationary frame section between an upright position and a tilted position;

a leg rest assembly supported from said seat assembly for movement between a retracted position when said seat assembly is in said upright position and an extended position when said seat assembly in said tilted position;

drive means for operatively connecting said seat assembly and said leg rest assembly, said drive means being moveable between a locked position wherein said seat assembly is retained in said upright position and a released position wherein said seat assembly is permitted to move toward said tilted position, said drive means including a transverse drive rod mounted at its opposite ends to opposite sides of said seat member for rotational movement with respect to said seat assembly and for translational movement with said seat assembly with respect to said stationary frame section;

first linkage means operatively coupling said drive means to said stationary frame section, said first linkage means operable such that said drive means moves in a first direction when said seat assembly moves from said upright position to said tilted position and said drive rod moves in a second direction when said seat assembly moves from said tilted position to said upright position, said first linkage means being operatively associated with said drive means for releasably locking said seat assembly in said upright position when said drive means is in said locked position, and said first linkage means permitting said seat assembly to move to said tilted position when said drive means is in said released position;

said leg rest assembly having a power swing link that is directly connected to said drive means such that movement of said drive means in said first direction moves said leg rest assembly from its retracted position to its extended position, and wherein movement of said leg rest assembly from its extended position to its retracted position moves said drive means in said second direction and in a translatory direction with respect to said stationary frame section for concurrently moving said seat assembly from said tilted position to said upright position;

second linkage means operatively coupling said drive means to said seat frame, said second linkage means operable for retaining said leg rest assembly in said retracted position when said drive means is in said locked position, and said second linkage means operable for driving said leg rest assembly towards said extended position when said drive means in said released position;

biasing means coupled inbetween said second linkage means and said seat assembly for generating a biasing force to aid said second linkage means in maintaining said leg rest assembly in said retracted position and in urging said leg rest assembly into said extended position;

coupling means for directly coupling said second linkage means to said power swing link of said leg rest assembly for assisting said drive means in moving said leg rest assembly between its retracted and extended positions; and a manually operated actuation mechanism coupled to said drive means for permitting a seat occupant to selectively rotate said drive means between said locked and released positions, said manually operated actuation mechanism including a lever pivotably secured to said seat frame, a short drive link having a first end directly coupled to said drive means and a second end pivotably coupled to a first end of a transfer link, a second end of said transfer link pivotably coupled to said lever for transferring the angular movement of said lever to said drive means, said lever operable to be pivoted through a predetermined actuation angle for operatively moving said first linkage means sufficiently to cause said drive means to move to said released position.

13. The seating unit of claim 12 wherein said support means includes track means that are downwardly angled from back to front of said seating unit and front pivot link means pivotably interconnecting a front portion of said seat member to said stationary frame section, and wherein said seat assembly includes wheel means which are disposed for rolling movement within said track means, whereby the weight of said seat assembly and said seat occupant urge said seat assembly toward said tilted position and assists said drive rod in continuing to rotate in said first direction for moving said leg rest assembly toward said extended position upon rotation of said actuator lever through said actuation angle.

14. The seating unit of claim 13 wherein said first linkage means comprises a toggle-lock linkage mechanism interconnected between said drive rod and said stationary frame section, whereby rotation of said drive rod moves said toggle-lock linkage mechanism and movement of said toggle-lock linkage mechanism rotates said drive rod.

15. The seating unit of claim 14 wherein said toggle-lock linkage mechanism comprises a two-bar linkage comprising a drive link having a first end directly coupled for rotation to said drive rod and a base link having a first end pivotally connected about a first pivot to a second end of said drive link, a second end of said base link pivotably connected about a second pivot to said stationary frame section, said toggle-lock linkage mechanism being operative to lock said seat assembly in said upright position and inhibit rotation of said drive rod in said first direction when said first pivot is below a line of center defined by said drive rod, and said toggle-lock linkage mechanism being operative to release said seat assembly for movement toward said tilted position and for permitting continued rotation of said drive rod in said first direction when said first pivot is above said line of center of said drive rod.

16. The seating unit of claim 15 wherein said leg rest assembly includes pantograph linkage means having said power swing link drivingly connected to said drive rod such that rotation of said drive rod moves said power swing link and said pantograph linkage means, and wherein movement of said pantograph linkage means causes movement of said power swing link for rotating said drive rod, and wherein said second linkage means includes a toggle linkage mechanism having a toggle lever directly connected for rotation with said drive rod and an over-center toggle means operatively coupled between said biasing means and said toggle lever, said over-center toggle means being adapted for retaining said leg rest assembly in said retracted position when said drive rod is in said locked position, and said over-center toggle means being adapted for forwardly driving said leg rest assembly toward said extended position upon release of said seat assembly.

17. The seating unit of claim 16 wherein said coupling means is adapted to directly interconnect said toggle lever to said power swing link.

18. The seating unit of claim 17 wherein said coupling means comprises at least one washer member interposed between adjacent sides of said toggle lever and said power swing link, said washer member being secured therebetween so as to facilitate movement of said power swing link during rotation of said drive rod.

19. The seating unit of claim 17 wherein said toggle lever is secured directly to said drive rod for rotation therewith, and wherein said over center toggle means includes a C-shaped toggle link having a first leg and a second rear leg, said toggle lever being pivotally coupled to said first leg of said C-shaped toggle link which curves around and below said drive rod to said second rear leg; and wherein said biasing means includes spring means secured between a portion of said seat assembly rearward of said toggle link and said second rear leg thereof, whereby said spring means urges said drive rod to rotate in said second direction for concurrently biasing said leg rest assembly toward its retracted position when said pivot connection between said toggle lever and said front leg of said toggle link is located below said line of center of said drive rod, and wherein said spring means acts to urge said drive rod to rotate in said first direction to forwardly drive said leg rest assembly toward its extended position when said pivot connection between said toggle lever and said front leg of said toggle link is located above said line of center of said drive rod.

20. The seating unit of claim 17 further including stop means associated with said pantograph linkage means for inhibiting additional forward movement of said seat assembly when said seat assembly is in said tilted position, and wherein said stop means inhibits further extension of said pantograph linkage means when said pantograph linkage means is in said extended position.

21. A seating unit for use in an article of furniture having a stationary outer frame comprising:

a seat assembly having a seat and a seat back defining a unitary carriage;

support means mounting said carriage on said outer frame for support of said carriage and for translatory movement of said carriage between an upright position and a tilted position located ahead of said upright position, said support means including substantially straight tracks mounted to said outer frame and a pair of wheels supported on said carriage and disposed in said tracks, said wheels having a transverse axle of rotation located adjacent a rearward bottom portion of said carriage, said support means including pivot link means acting between said carriage and said outer frame for tilting said carriage about said axis of rotation during movement of said carriage between said upright and tilted positions such that a front portion of said seat member is elevated when said carriage moves toward said tilted position, said tracks being located on a angle with their back portion being higher than their front portions whereby the weight of said carriage and a seat occupant seated in said carriage provides a force acting to move said carriage toward said tilted position;

first toggle link means operably connected between a transverse drive rod rotatably mounted on said carriage and said outer frame, said first toggle link means being operable for releasably holding said carriage in said upright position;

manually operated release means coupled directly to said drive rod for moving said first toggle link means so as to release said carriage, said first toggle link means being operatively connected to said drive rod such that rotation of said drive rod moves said first toggle link means and movement of said first toggle link means rotates said drive rod, said manually operated actuation means being directly connected to said drive rod so as to rotate said drive rod through a predetermined actuation angle for sufficiently moving said first toggle link means so as to release said carriage;

a leg rest assembly having pantograph linkage means operatively connected between said carriage and said drive rod such that rotation of said drive rod moves said leg rest assembly from a retracted position to an extended position and movement of said leg rest assembly from said extended position to said retracted position rotates said drive rod and causes translational movement of said drive rod operable for moving said carriage from said tilted position to said upright position, said leg rest assembly being located in said retracted position when said carriage is located in said upright position and wherein said leg rest assembly is automatically moved to said extended position when said carriage is moved to said tilted position;

second toggle link means connected between said seat frame and said drive rod and operable such that movement of said drive rod moves said second toggle link means and movement of said second toggle link means moves said drive rod, said second toggle link means releasably holding said leg rest assembly in said retracted and said extended positions;

biasing means coupled in between said seat assembly and said second toggle link means for aiding said second toggle link means in holding said leg rest assembly in said retracted position and for helping said second toggle link means to urge said leg rest assembly into said extended position;

coupling means for directly coupling said second toggle link means to said leg rest pantograph linkage means for facilitating movement of said toggle link means and said leg rest linkage means with said drive rod; and stop means associated with said leg rest pantograph linkage means for limiting forward movement of said carriage and for limiting forward extension of said leg rest linkage means.

* * * * *

UNITED STATES PATENT AND TRADEMARK OFFICE

CERTIFICATE OF CORRECTION

PATENT NO. : 5,217,276

DATED : June 8, 1993

INVENTOR(S) : Larry P. LaPointe

It is certified that error appears in the above-identified patent and that said Letters Patent is hereby corrected as shown below:

On The Title Page -

"Chair Mechanism" should be --Two Way Incliner Chair Mechanism--.

Column 1, Line 2,

"Chair Mechanism" should be --Two Way Incliner Chair Mechanism--.

Column 2, Line 68,
"fringing" should be --bringing--.

Column 9, Line 51,
"mechanism" should be --mechanisms--.

Column 9, Lines 51-52,
"linkage" should be --linkages--.

Column 20, Lines 5, Claim 21,

After "said" insert --second--.

Signed and Sealed this

Twenty-ninth Day of March, 1994

Bruce Lehman

*Attest:*

BRUCE LEHMAN

*Attesting Officer*

*Commissioner of Patents and Trademarks*